US010607759B2

(12) United States Patent
Deligianni et al.

(10) Patent No.: US 10,607,759 B2
(45) Date of Patent: Mar. 31, 2020

(54) METHOD OF FABRICATING A LAMINATED STACK OF MAGNETIC INDUCTOR

(71) Applicant: International Business Machines Corporation, Armonk, NY (US)

(72) Inventors: Hariklia Deligianni, Alpine, NJ (US); Bruce B. Doris, Hartsdale, NY (US); Eugene J. O'Sullivan, Nyack, NY (US); Naigang Wang, Ossining, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/476,147

(22) Filed: Mar. 31, 2017

(65) Prior Publication Data

US 2018/0286582 A1 Oct. 4, 2018

(51) Int. Cl.

| | |
|---|---|
| ***H01F 3/04*** | (2006.01) |
| ***H01F 7/06*** | (2006.01) |
| ***H01F 17/00*** | (2006.01) |
| ***H01F 41/04*** | (2006.01) |
| ***H01F 17/04*** | (2006.01) |
| ***H01F 41/02*** | (2006.01) |

(52) U.S. Cl.

CPC ..... *H01F 17/0006* (2013.01); *H01F 17/0013* (2013.01); *H01F 17/04* (2013.01); *H01F 41/0233* (2013.01); *H01F 41/046* (2013.01); *H01F 2017/0053* (2013.01); *H01F 2017/0066* (2013.01)

(58) Field of Classification Search

CPC .. H01F 41/0206; H01F 27/2823; H01F 27/24; H01F 1/14708

See application file for complete search history.

(56) References Cited

U.S. PATENT DOCUMENTS

| | | | |
|---|---|---|---|
| 5,194,806 | A | 3/1993 | Obama |
| 5,576,099 | A | 11/1996 | Canaperi et al. |
| 5,756,201 | A | 5/1998 | Kadono et al. |
| 5,774,025 | A | 6/1998 | Adam et al. |
| 6,184,143 | B1 | 2/2001 | Ohashi et al. |
| 6,346,336 | B1 | 2/2002 | Nago |
| 6,377,157 | B1 | 4/2002 | Liu et al. |

(Continued)

FOREIGN PATENT DOCUMENTS

CN 102529211 A 7/2012

OTHER PUBLICATIONS

Deligianni et al.; "Laminated Magnetic Inductor Stack With High Frequency Peak Quality Factor"; U.S. Appl. No. 15/479,615, filed Apr. 5, 2017.

(Continued)

*Primary Examiner* — Paul D Kim

(74) *Attorney, Agent, or Firm* — Cantor Colburn LLP; Vazken Alexanian

(57) ABSTRACT

Embodiments are directed to a method of forming a laminated magnetic inductor and resulting structures having anisotropic magnetic layers. A first magnetic stack is formed having one or more magnetic layers alternating with one or more insulating layers. A trench is formed in the first magnetic stack oriented such that an axis of the trench is perpendicular to a hard axis of the magnetic inductor. The trench is filled with a dielectric material.

12 Claims, 12 Drawing Sheets

(56) References Cited

U.S. PATENT DOCUMENTS 6,504,466 B1 1/2003 Katsurada
6,593,838 B2 7/2003 Yue
6,613,459 B1 * 9/2003 Saito ..... B82Y 10/00 427/127
6,630,255 B1 10/2003 Litvinov et al.
6,731,460 B2 5/2004 Sasaki
6,759,297 B1 7/2004 Dvorsky et al.
6,943,658 B2 * 9/2005 Gardner ..... H01F 17/0006 257/E21.022
6,982,196 B2 1/2006 Belyansky et al.
7,016,170 B2 3/2006 Nishioka
7,202,516 B2 4/2007 Belyansky et al.
7,238,990 B2 7/2007 Burnett et al.
7,380,328 B2 6/2008 Ahn et al.
7,488,659 B2 2/2009 Dyer
7,737,052 B2 6/2010 Bhatia et al.
7,755,124 B2 7/2010 Fajardo et al.
7,791,837 B2 9/2010 Fujiwara
7,847,668 B2 12/2010 Lai et al.
7,906,383 B2 3/2011 Richter et al.
7,936,246 B2 5/2011 Hopper et al.
7,982,286 B2 7/2011 Rossi et al.
8,044,755 B2 10/2011 Smeys et al.
8,049,993 B2 * 11/2011 Shirotori ..... G11B 5/855 360/135
8,093,981 B2 1/2012 Chung
8,278,164 B2 10/2012 Li et al.
8,299,615 B2 10/2012 Fayaz et al.
8,308,964 B2 * 11/2012 Xu ..... G11B 5/743 216/22
8,314,676 B1 11/2012 Smeys et al.
8,323,728 B2 12/2012 Iorio et al.
8,354,694 B2 1/2013 Bedell et al.
8,466,537 B1 6/2013 Papou et al.
8,587,400 B2 11/2013 Nakajima et al.
8,691,696 B2 4/2014 Cai et al.
8,698,328 B2 4/2014 Nair et al.
8,704,627 B2 4/2014 Kuroda
8,717,136 B2 5/2014 Fontana, Jr. et al.
8,736,413 B2 5/2014 Yokoyama et al.
8,749,338 B2 6/2014 Takahashi
8,823,482 B2 9/2014 Singh et al.
9,047,890 B1 6/2015 Herget
9,129,817 B2 9/2015 Elsherbini et al.
9,153,547 B2 10/2015 Crawford et al.
9,231,072 B2 1/2016 Alptekin
9,324,495 B2 4/2016 Fontana, Jr. et al.
9,356,121 B2 5/2016 Jagannathan
9,412,866 B2 8/2016 Kuoh et al.
9,437,668 B1 9/2016 Deligianni et al.
9,697,948 B2 7/2017 Osada et al.
9,799,519 B1 10/2017 Joseph
10,236,209 B2 3/2019 Sharan et al.
2001/0050607 A1 12/2001 Gardner
2003/0077871 A1 4/2003 Cheng et al.
2004/0046631 A1 3/2004 Sakakura et al.
2004/0219328 A1 11/2004 Tasaki et al.
2006/0222821 A1 10/2006 Masai
2007/0030659 A1 2/2007 Suzuki et al.
2007/0285835 A1 12/2007 Sun et al.
2008/0036536 A1 2/2008 Khorramabadi
2008/0284552 A1 11/2008 Lim et al.
2011/0050607 A1 3/2011 Park
2011/0133880 A1 6/2011 Pitts et al.
2011/0172111 A1 7/2011 Cantor et al.
2012/0233849 A1 * 9/2012 Smeys ..... H01F 17/0006 29/604
2012/0236528 A1 9/2012 Le et al.
2012/0267733 A1 10/2012 Hu et al.
2012/0319236 A1 12/2012 Chen et al.
2013/0056847 A1 3/2013 Chen
2013/0106552 A1 5/2013 Fontana, Jr. et al.
2013/0224887 A1 8/2013 Lee et al.
2014/0027880 A1 1/2014 Duevel et al.
2014/0062646 A1 3/2014 Morrissey et al.
2014/0068932 A1 3/2014 Sturcken
2014/0216939 A1 8/2014 Fontana, Jr. et al.
2014/0349414 A1 11/2014 Zhong et al.
2015/0109088 A1 4/2015 Kim et al.
2015/0115404 A1 4/2015 Hsueh et al.
2015/0137931 A1 5/2015 Mano et al.
2015/0171157 A1 6/2015 Sturcken et al.
2015/0187772 A1 7/2015 Choi et al.
2015/0338474 A1 * 11/2015 Mohan ..... G01R 33/04 257/425
2015/0340149 A1 11/2015 Lee et al.
2016/0086960 A1 3/2016 Wen et al.
2016/0260708 A1 9/2016 Herget et al.
2017/0179154 A1 6/2017 Furihata
2017/0250134 A1 8/2017 Sturcken et al.
2018/0005741 A1 1/2018 Doris et al.
2018/0308612 A1 10/2018 Park et al.
2019/0157000 A1 5/2019 Deligianni et al.

OTHER PUBLICATIONS

Deligianni et al.; "Magnetic Inductor Stack Including Insulating Material Having Multiple Thicknesses"; U.S. Appl. No. 15/584,766, filed May 2, 2017.
Deligianni et al.; "Magnetic Inductor Stack Including Magnetic Materials Having Multiple Permeabilities"; U.S. Appl. No. 15/494,871, filed Apr. 24, 2017.
Deligianni et al.; "Magnetic Inductor With Multiple Magnetic Layer Thicknesses"; U.S. Appl. No. 15/473,725, filed Mar. 30, 2017.
List of IBM Patents or Patent Applications Treated As Related; Date Filed: Jan. 15, 2018, 2 pages.
Deligianni et al.; "Magnetic Inductor Stack Including Magnetic Materials Having Multiple Permeabilities"; U.S. Appl. No. 15/966,202, filed Apr. 30, 2018.
List of IBM Patents or Patent Applications Treated As Related; Date Filed: Apr. 30, 2018, 2 pages.
Deligianni et al., "Magnetic Inductor With Multiple Magnetic Layer Thicknesses", U.S. Appl. No. 16/236,795, filed Dec. 31, 2018.
Gao, "Significantly Enhanced Inductance and Quality Factor of GHz Integrated Magnetic Solenoid Inductors With FeGaB/A12O3 Multilayer Films", IEEE Transactions on Electron Devices, vol. 61, No. 5, May 2014, pp. 1470-1476, IEEE.
Iakubov et al., "Control over magnetic spectrum of multilayer magnetic film metamaterial," AIP Advances, vol. 5, No. 7, 2015, 077116, 7 pages.
List of IBM Patents or Patent Applications Treated As Related; (Appendix P), Date Filed Apr. 22, 2019; 2 pages.
Deligianni et al., "Stress Management for Thick Magnetic Film Inductors," U.S. Appl. No. 151599,754, filed May 19, 2017.
Deligianni et al., "Stress Management for Thick Magnetic Film Inductors," U.S. Appl. No. 16/107,102, filed Aug. 21, 2018.
Deligianni et al., "Magnetic Inductor Stacks," U.S. Appl. No. 15/403,292, filed Jan. 11, 2017.
Deligianni et al., "Magnetic Inductor Stacks," U.S. Appl. No. 15/800,702, filed Nov. 1, 2017.
List of IBM Patents or Patent Applications Treated As Related; (Appendix P), Date Filed Oct. 10, 2018; 2 pages.
E. Quandt et al., "Magnetostrictive LC circuit sensors," Materials Transactions, vol. 45, No. 2, 2004, pp. 244-248.
Deligianni et al., "Stress Management for Thick Magnetic Film Inductors," U.S. Appl. No. 16/391,383, filed Apr. 23, 2019.
Deligianni et al., "Laminated Magnetic Inductor Stack With High Frequency Peak Quality Factor," U.S. Appl. No. 16/591,964, filed Oct. 3, 2019.
Deligianni et al., "Magnetic Inductor With Shape Anisotrophy," U.S. Appl. No. 16/591,954, filed Oct. 3, 2019.
List of IBM Patents or Patent Applications Treated As Related; Date Filed: Nov. 5, 2019; 2 pages.

* cited by examiner

METHOD OF FABRICATING A LAMINATED STACK OF MAGNETIC INDUCTOR

BACKGROUND

The present invention generally relates to fabrication methods and resulting structures for on-chip magnetic devices. More specifically, the present invention relates to on-chip magnetic structures, e.g., a laminated magnetic inductor stack, having anisotropic magnetic layers.

Inductors, resistors, and capacitors are the main passive elements constituting an electronic circuit. Inductors are used in circuits for a variety of purposes, such as in noise reduction, inductor-capacitor (LC) resonance calculators, and power supply circuitry. Inductors can be classified as one of various types, such as a winding-type inductor or a laminated film-type inductor. Winding-type inductors are manufactured by winding a coil around, or printing a coil on, a ferrite core. Laminated film-type inductors are manufactured by stacking alternating magnetic or dielectric materials to form laminated stacks.

Among the various types of inductors the laminated film-type inductor is widely used in power supply circuits requiring miniaturization and high current due to the reduced size and improved inductance per coil turn of these inductors relative to other inductor types. A known laminated inductor configuration includes one or more magnetic or dielectric layers laminated with conductive patterns. The conductive patterns are sequentially connected by a conductive via formed in each of the layers and overlapped in a laminated direction to form a spiral-structured coil. Typically, both ends of the coil are drawn out to an outer surface of a laminated body for connection to external terminals.

SUMMARY

Embodiments of the present invention are directed to a method for fabricating a laminated stack of a magnetic inductor. A non-limiting example of the method includes forming a first magnetic stack having one or more magnetic layers alternating with one or more insulating layers. A trench is formed in the first magnetic stack oriented such that an axis of the trench is perpendicular to a hard axis of the magnetic inductor. The trench is then filled with a dielectric material.

Embodiments of the present invention are directed to a method for fabricating a laminated stack of a magnetic inductor. A non-limiting example of the method includes forming a first magnetic layer proximate to a conductive coil of the laminated magnetic inductor. A second magnetic layer is also formed proximate to the conductive coil. A third magnetic layer is formed between the first and second magnetic layers such that the third magnetic layer is further from the conductive coil than either the first magnetic layer or the second magnetic layer. One or more trenches are formed in the first and second magnetic layers such that an axis of each of the trenches is perpendicular to a hard axis of the magnetic inductor. The one or more trenches are then filled with a dielectric material.

Embodiments of the present invention are directed to a laminated magnetic inductor. A non-limiting example of the laminated magnetic inductor includes a first magnetic stack patterned with a trench. The first magnetic stack includes one or more magnetic layers alternating with one or more insulating layers. The trench is oriented such that an axis of the trench is perpendicular to a hard axis of the laminated magnetic inductor. The trench is filled with a dielectric material. A second magnetic stack is formed opposite a major surface of the first magnetic stack. The second magnetic stack includes one or more magnetic layers alternating with one or more insulating layers.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification.

The foregoing and other features and advantages of the embodiments of the invention are apparent from the following detailed description taken in conjunction with the accompanying drawings in which.

Figure 1:
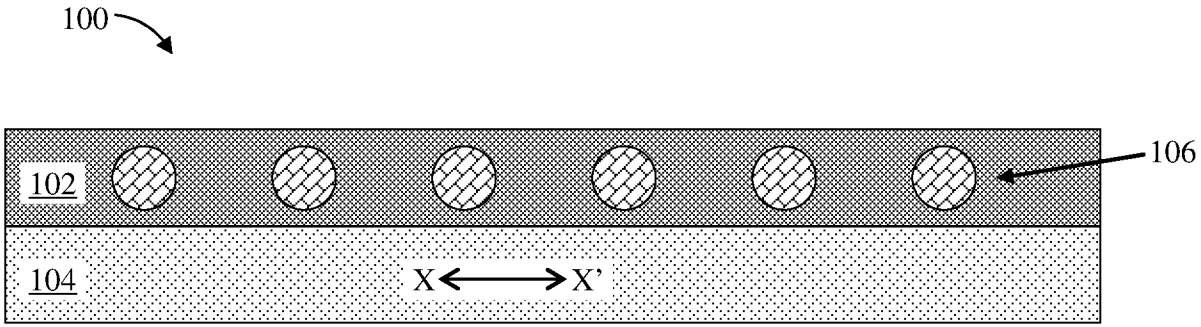
FIG. 1 depicts a laminated magnetic inductor after a fabrication operation according to embodiments of the invention.

The diagrams depicted herein are illustrative. There can be many variations to the diagram or the operations described therein without departing from the spirit of the invention. For instance, the actions can be performed in a differing order or actions can be added, deleted or modified.

In the accompanying figures and following detailed description of the disclosed embodiments, the various elements illustrated in the figures are provided with two or three digit reference numbers. With minor exceptions, the leftmost digit(s) of each reference number correspond to the figure in which its element is first illustrated.

DETAILED DESCRIPTION

For the sake of brevity, conventional techniques related to semiconductor device and integrated circuit (IC) fabrication may or may not be described in detail herein. Moreover, the various tasks and process steps described herein can be incorporated into a more comprehensive procedure or process having additional steps or functionality not described in detail herein. In particular, various steps in the manufacture of laminated inductor devices are well known and so, in the interest of brevity, many conventional steps will only be mentioned briefly herein or will be omitted entirely without providing the well-known process details.

Turning now to an overview of technologies that are more specifically relevant to aspects of the invention, as previously noted herein, laminated film-type inductors offer reduced size and improved inductance per coil turn relative to other inductor types. For this reason, laminated film-type inductors are widely used in applications requiring miniaturization and high current, such as power supply circuitry. The integration of inductive power converters onto silicon is one path to reducing the cost, weight, and size of electronic devices.

Laminated film-type inductor performance can be improved by adding layers of magnetic film. There are two basic laminated film-type magnetic inductor configurations: the closed yoke type laminated inductor and the solenoid type laminated inductor. The closed yoke type laminated inductor includes a metal core (typically a copper wire) and magnetic material wrapped around the core. Conversely, the solenoid type laminated inductor includes a magnetic material core and a conductive wire (e.g., copper wire) wrapped around the magnetic material. Both the closed yoke type laminated inductor and the solenoid type laminated inductor benefit by having very thick magnetic stacks or yokes (e.g., magnetic layers having a thickness of about 200 nm). Thick magnetic layers offer faster throughput and are significantly more efficient to deposit. There are challenges, however, in providing laminated film-type inductor architectures having thick magnetic layers.

One such challenge is addressing the increased loss in energy due to the powerful eddy currents associated with inductors having thick magnetic films. Eddy currents (also known as Foucault currents) are loops of electrical current induced by a changing magnetic field in a conductor. Eddy currents flow in closed loops within conductors in a plane perpendicular to the magnetic field. Eddy currents are created when the time varying magnetic fields in the magnetic layers create an electric field that drives a circular current flow. These losses can be substantial and increase with the thickness of the magnetic layers. As magnetic film thicknesses increase, the eddy currents become severe enough to degrade the quality factor (also known as "Q") of the inductor. The quality factor of an inductor is the ratio of its inductive reactance to its resistance at a given frequency, and is a measure of its efficiency. Some applications can require the peak or maximum Q to be at a low frequency and other applications can require the peak Q to be at a high frequency.

The magnetic loss caused by eddy currents in a thick film inductor is largest in the region of the inductor where the coil is in close proximity to the magnetic material. Specifically, magnetic layers closer to the coil (that is, the "inner layers") have larger losses than magnetic layers further from the coil (the "outer layers"). Moreover, magnetic flux densities in the space occupied by inner layers are generally higher than those characterizing the outer layers due to the magnetic reluctance of the insulating layers (also called spacer layers) interposed between the winding and the outer layers. Due to these relatively large magnetic flux densities in the space occupied by the inner layers, the inner layers tend to magnetically saturate at lower drive currents and have greater losses than the outer layers. Accordingly, the inner layer region is a critical region—the losses in this critical region dominate the overall losses of the inductor. Consequently, if losses can be mitigated or controlled in this critical region the overall performance (i.e., quality factor) of the inductor can be improved.

Turning now to an overview of the aspects of the invention, one or more embodiments of the invention address the above-described shortcomings by providing methods of fabricating a laminated magnetic inductor having anisotropic magnetic layers. Magnetic anisotropy is the directional dependence of a material's magnetic properties. In the absence of an applied magnetic field, a magnetically isotropic material has no preferential direction for its magnetic moment, while a magnetically anisotropic material will align its moment along an energetically favorable direction of spontaneous magnetization (i.e., the easy axis) in the presence of an applied magnetic field. The two opposite directions along an easy axis are usually equivalent, and the actual direction of magnetization can be along either of them. In contrast to the easy axis, the hard axis is the direction of maximum energy (i.e., the least energetically favorable direction of spontaneous magnetization). The anisotropic magnetic layers are formed by patterning regions of the inductor into sections perpendicular or parallel to the hard axis—effectively modifying the permeability of these layers.

Permeability ($\mu$) is the degree of magnetization that a material obtains in response to an applied magnetic field. Incorporating magnetic materials with high permeability in an inductor advantageously increases inductance (and Q) but also results in increased losses. Conversely, decreasing permeability can reduce inductance (and Q) but advantageously reduces losses. Adjusting the permeability of a laminated stack can also be used to modulate or adjust the frequency of peak Q—the frequency at which the maximum attainable Q occurs for a given inductor is, in general, inversely proportional to permeability.

By patterning specific regions of the inductor into sections perpendicular or parallel to the hard axis magnetic losses can be minimized, Q can be improved, and the frequency of peak Q can be adjusted. In particular, inner regions of the inductor (i.e., those critical regions proximate to the conductive coil) are patterned with trenches perpendicular to the hard axis to decrease the effective permeability of the inner layers. In this manner, eddy current losses are minimized in the most critical regions. The outer regions of the inductor (i.e., those regions positioned farther away from the conductive coil than the inner regions) are either not patterned or are patterned with trenches parallel to the hard axis, depending on the specific application. Not patterning the outer regions increases throughput due to the similar processing scheme. Alternatively, patterning the outer regions with trenches parallel to the hard axis effectively increases the permeability of the outer layers. Increasing the effective permeability of the outer layers improves inductance and increases Q while allowing for the higher losses associated with high permeability layers to be confined to less critical regions of the inductor (i.e., the outer regions).

Turning now to a more detailed description of aspects of the present invention, FIG. 1 depicts a cross-sectional view of a structure 100 along a direction X-X' (the hard axis direction) having a dielectric layer 102 (also referred to as a bottom dielectric layer) formed opposite a major surface of a substrate 104 during an intermediate operation of a method of fabricating a semiconductor device according to embodiments of the invention. The dielectric layer 102 can be any suitable material, such as, for example, a low-k dielectric, silicon nitride (SiN), silicon dioxide ($SiO_2$), silicon oxynitride (SiON), and silicon oxycarbonitride (SiOCN). Any known manner of forming the dielectric layer 102 can be utilized. In some embodiments, the dielectric layer 102 is $SiO_2$ conformally formed on exposed surfaces of the substrate 104 using a conformal deposition process such as PVD, CVD, plasma-enhanced CVD (PECVD), or a combination thereof. In some embodiments, the dielectric layer 102 is conformally formed to a thickness of about 5 to 10 nm or more, although other thicknesses are within the contemplated scope of embodiments of the invention.

The substrate 104 can be a wafer and can have undergone known semiconductor front end of line processing (FEOL), middle of the line processing (MOL), and back end of the line processing (BEOL). FEOL processes can include, for example, wafer preparation, isolation, well formation, gate patterning, spacer, extension and source/drain implantation, and silicide formation. The MOL can include, for example, gate contact formation, which can be an increasingly challenging part of the whole fabrication flow, particularly for lithography patterning. In the BEOL, interconnects can be fabricated with, for example, a dual damascene process using PECVD deposited interlayer dielectric (ILDs), PVD metal barriers, and electrochemically plated conductive wire materials. The substrate 104 can include a bulk silicon substrate or a silicon on insulator (SOI) wafer. The substrate 104 can be made of any suitable material, such as, for example, Ge, SiGe, GaAs, InP, AlGaAs, or InGaAs.

A conductive coil 106 is formed in the dielectric layer 102 and a dielectric layer 1100 (depicted in FIG. 12) and helically around portions of the structure 100. The conductive coil 106 can be formed by, for example, depositing copper lines in the dielectric layer 102, forming vias on top of the copper lines, and then depositing copper lines on top of the vias in the dielectric layer 1100. For ease of discussion reference is made to operations performed on and to a conductive coil 106 having six turns or windings formed in the dielectric layer 102 (e.g., the conductive coil 106 wraps through the dielectric layer 102 a total of six times). It is understood, however, that the dielectric layer 102 can include any number of windings. For example, the dielectric layer 102 can include a single winding, 2 windings, 5 windings, 10 windings, or 20 windings, although other winding counts are within the contemplated scope of embodiments of the invention. The conductive coil 106 can be made of any suitable conducting material, such as, for example, metal (e.g., tungsten, titanium, tantalum, ruthenium, zirconium, cobalt, copper, aluminum, lead, platinum, tin, silver, gold), conducting metallic compound material (e.g., tantalum nitride, titanium nitride, tantalum carbide, titanium carbide, titanium aluminum carbide, tungsten silicide, tungsten nitride, ruthenium oxide, cobalt silicide, nickel silicide), carbon nanotube, conductive carbon, graphene, or any suitable combination of these materials.

Figure 2:
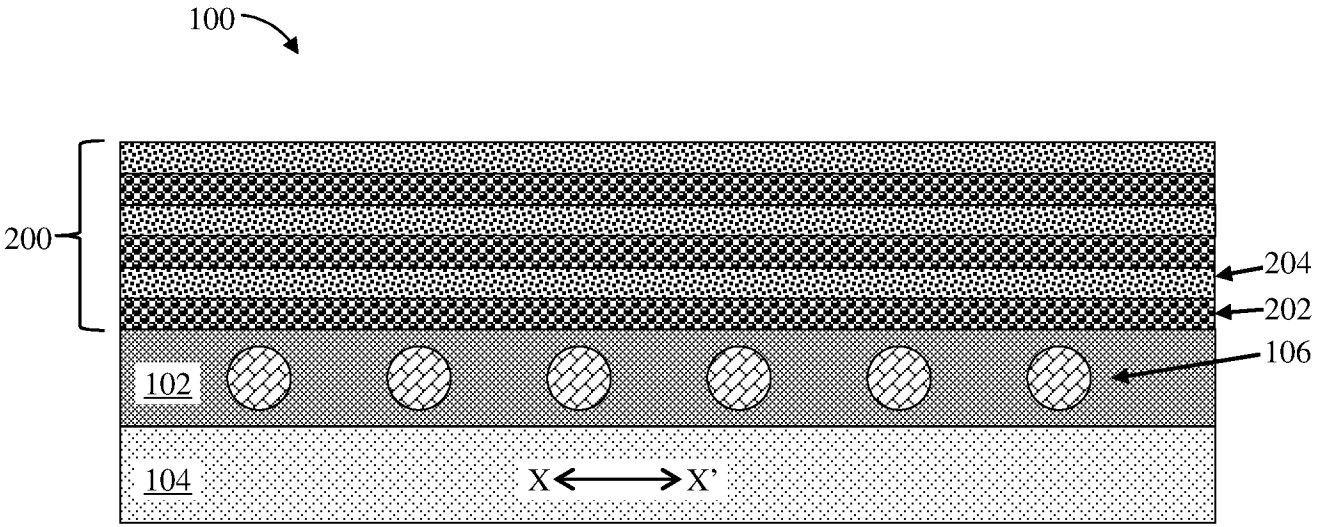
FIG. 2 depicts a laminated magnetic inductor after a fabrication operation according to embodiments of the invention.

FIG. 2 depicts a cross-sectional view of the structure 100 along the direction X-X' after forming a first inner layer region 200 opposite a major surface of the dielectric layer 102 during an intermediate operation of a method of fabricating a semiconductor device according to embodiments of the invention. The first inner layer region 200 (also referred to as a magnetic stack) includes one or more inner magnetic layers (e.g., inner magnetic layer 202) alternating with one or more insulating layers (e.g., insulating layer 204). The first inner layer region 200 is formed by depositing alternating magnetic and insulating layers. For ease of discussion the first inner layer region 200 is depicted as having three inner magnetic layers alternating with three insulating layers. It is understood, however, that the first inner layer region 200 can include any number of inner magnetic layers alternating with a corresponding number of insulating layers. For example, the first inner layer region 200 can include a single inner magnetic layer, two inner magnetic layers, five inner magnetic layers, eight inner magnetic layers, or any number of inner magnetic layers, along with a corresponding number of insulating layers (i.e., as appropriate to form an inner layer region having a topmost insulating layer on a topmost inner magnetic layer and an insulating layer between each pair of adjacent inner magnetic layers).

The inner magnetic layer 202 can be made of any suitable magnetic material known in the art, such as, for example, a ferromagnetic material, soft magnetic material, iron alloy, nickel alloy, cobalt alloy, ferrites, plated materials such as permalloy, or any suitable combination of these materials. In some embodiments, the inner magnetic layer 202 includes a Co containing magnetic material, FeTaN, FeNi, FeAlO, or combinations thereof. Any known manner of forming the inner magnetic layer 202 can be utilized. The inner magnetic layer 202 can be deposited through vacuum deposition technologies (i.e., sputtering) or electrodepositing through an aqueous solution. In some embodiments, the inner magnetic layer 202 is conformally formed on exposed surfaces of the dielectric layer 102 using a conformal deposition process such as PVD, CVD, PECVD, or a combination thereof. In some embodiments, the inner magnetic layer 202 is conformally formed to a thickness of about 50 nm to about 200 nm, although other thicknesses are within the contemplated scope of embodiments of the invention.

The insulating layer 204 serves to isolate the adjacent magnetic material layers from each other in the stack and can be made of any suitable non-magnetic insulating material known in the art, such as, for example, aluminum oxides (e.g., alumina), silicon oxides (e.g., $SiO_2$), silicon nitrides, silicon oxynitrides ($SiO_xN_y$), polymers, magnesium oxide (MgO), or any suitable combination of these materials. Any known manner of forming the insulating layer 204 can be utilized. In some embodiments, the insulating layer 204 is conformally formed on exposed surfaces of the inner magnetic layer 202 using a conformal deposition process such as PVD, CVD, PECVD, or a combination thereof. The insulating layer 204 can be about one half or greater of the thickness of the inner magnetic layer 202. In some embodiments, the insulating layers in the first inner layer region 200 (e.g., insulating layer 204) can have a thickness of about 5 nm to about 10 nm, for example, about 10 nm.

Figure 3:
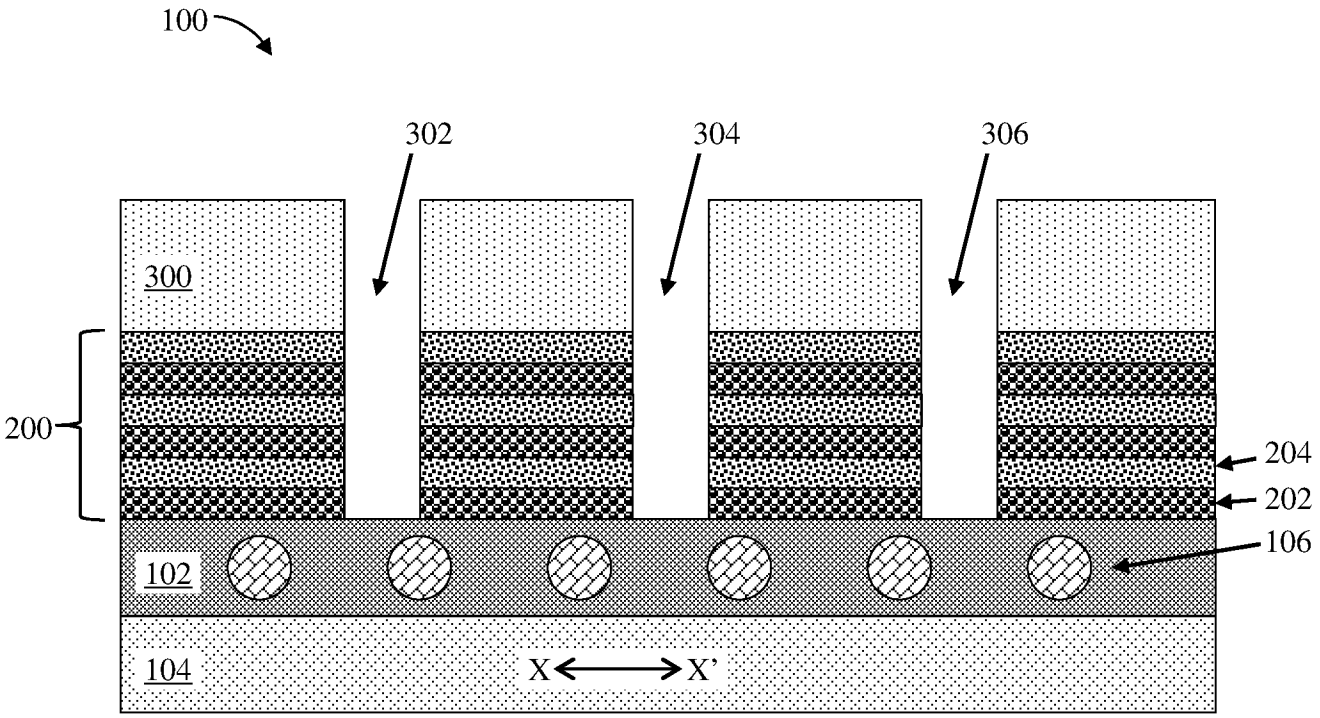
FIG. 3 depicts a laminated magnetic inductor after a fabrication operation according to embodiments of the invention.

FIG. 3 depicts a cross-sectional view of the structure 100 along the direction X-X' after patterning the first inner layer region 200 during an intermediate operation of a method of fabricating a semiconductor device according to embodiments of the invention. Any known method for patterning laminated stacks can be used, such as, for example, a wet etch, a dry etch, or a combination of sequential wet and/or dry etches. The first inner layer region 200 is patterned by removing portions of the first inner layer region 200 to form trenches (e.g., trenches 302, 304, and 306) exposing portions of the dielectric layer 102 in a direction Y-Y' perpendicular to the direction X-X'. In some embodiments, the first inner layer region 200 is patterned selective to the dielectric layer 102. In some embodiments, the first inner layer region 200 is patterned by forming a patterned hard mask 300 (e.g., a photoresist) over the first inner layer region 200 and selectively removing exposed portions of the first inner layer region 200 using RIE. For ease of discussion reference is made to operations performed on and to a structure 100 having three trenches (e.g., the trenches 302, 304, and 306). It is understood, however, that the structure 100 can be patterned to include any number of trenches.

Removing portions of the first inner layer region 200 in this manner (i.e., patterning the first inner layer region 200 into sections perpendicular to the hard axis) effectively decreases the permeability of the first inner layer region 200. As discussed previously herein, decreasing the effective permeability of the inner layers reduces the eddy current losses in these critical regions. Moreover, the frequency at which the maximum attainable Q (peak Q) occurs for a given inductor is, in general, inversely proportional to permeability. Consequently, increasing or decreasing the number or size of the trenches (e.g., trenches 302, 304, and 306) further decreases or increases, respectfully, the effective permeability of the first inner layer region 200 and correspondingly shifts the frequency of peak Q. In some embodiments, the effective permeability of the first inner layer region 200 is increased to decrease the frequency of peak Q. In some embodiments, the effective permeability of the first inner layer region 200 is further decreased to increase the frequency of peak Q.

Figure 4:
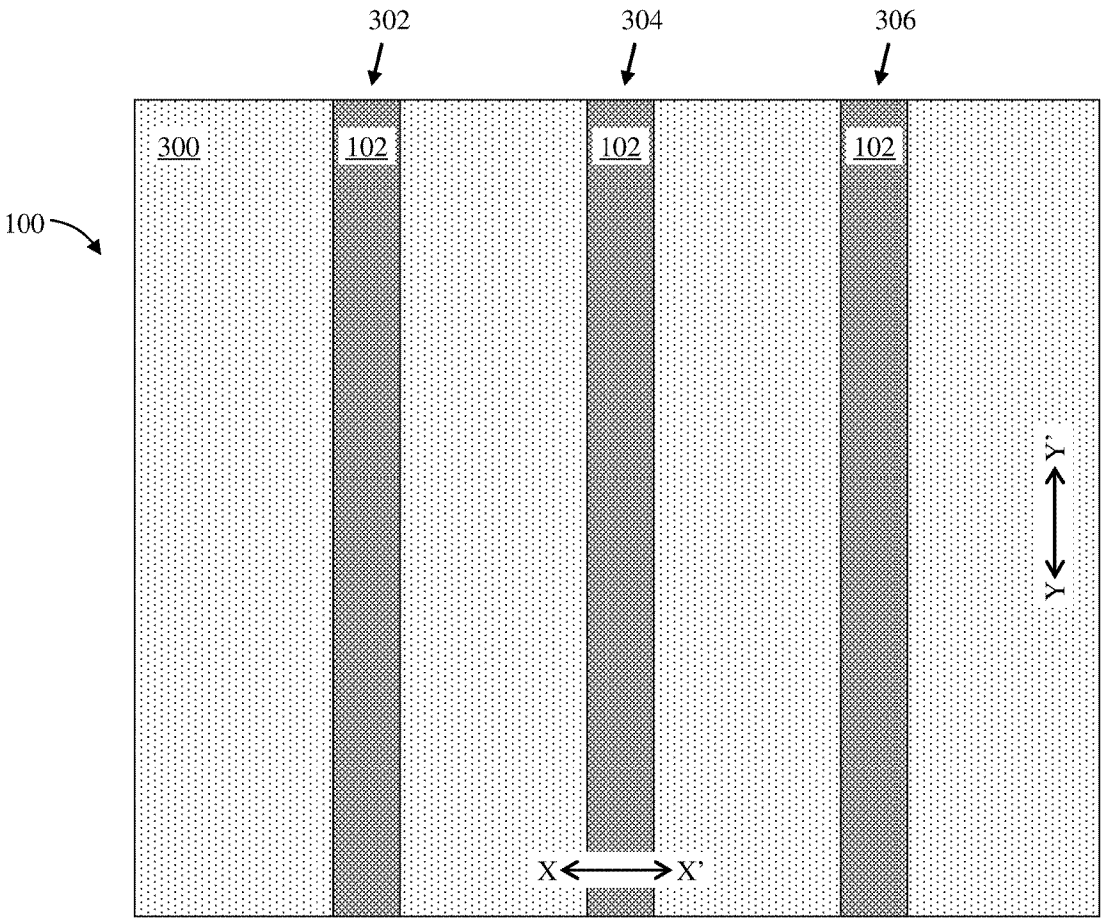
FIG. 4 depicts a laminated magnetic inductor after a fabrication operation according to embodiments of the invention.

FIG. 4 depicts a top-down view of the structure 100 after patterning the first inner layer region 200 during an intermediate operation of a method of fabricating a semiconductor device according to embodiments of the invention. From this view it is clear that the exposed portions of the dielectric layer 102 run perpendicular to the direction X-X'.

Figure 5:
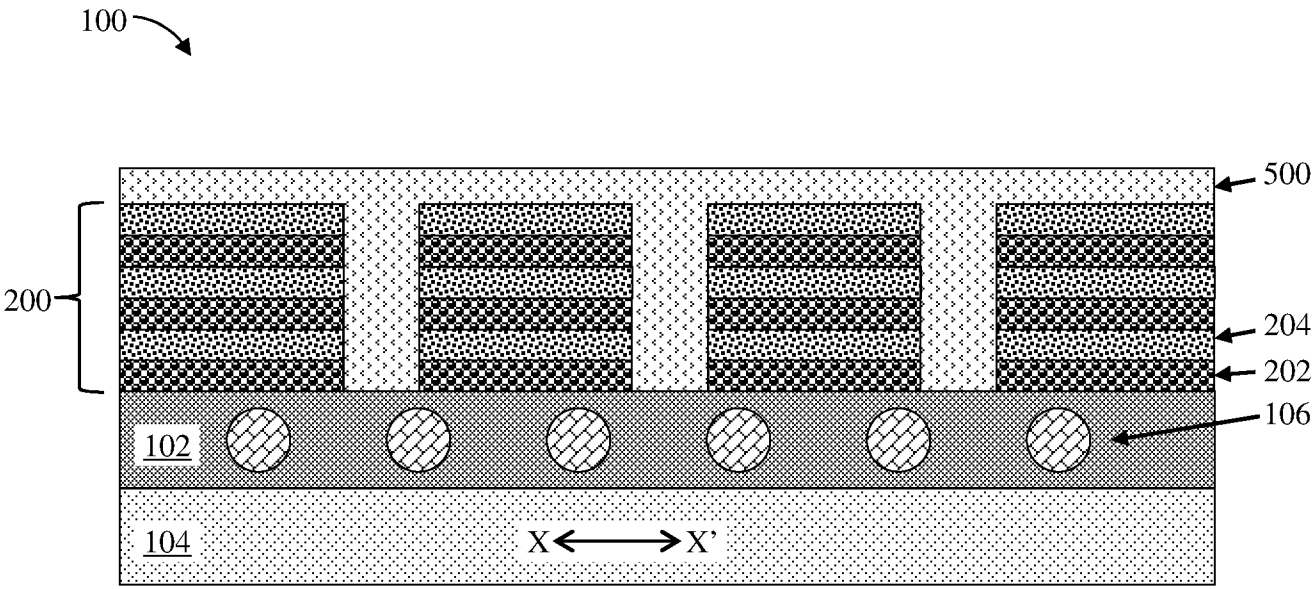
FIG. 5 depicts a laminated magnetic inductor after a fabrication operation according to embodiments of the invention.

FIG. 5 depicts a cross-sectional view of the structure 100 along the direction X-X' after filling the trenches 302, 304, and 306 with a dielectric layer 500 during an intermediate operation of a method of fabricating a semiconductor device according to embodiments of the invention. The dielectric layer 500 can be made of any suitable dielectric material known in the art, such as, for example, aluminum oxides (e.g., alumina), silicon oxides (e.g., $SiO_2$), silicon nitrides, silicon oxynitrides ($SiO_xN_y$), polymers, magnesium oxide (MgO), or any suitable combination of these materials. Any known manner of forming the dielectric layer 500 can be utilized. In some embodiments, the dielectric layer 500 is conformally formed using a conformal deposition process such as PVD, CVD, PECVD, or a combination thereof. The dielectric layer 500 can be overfilled above a major surface of the first inner layer region 200. In some embodiments, the dielectric layer 500 is conformally formed to a thickness of about 5 nm to about 10 nm above a major surface of the first inner layer region 200, although other thicknesses are within the contemplated scope of embodiments of the invention. In some embodiments, the dielectric layer 500 is planarized using, for example, a CMP selective to the major surface of the first inner layer region 200. In some embodiments, a hard mask (not depicted) can be used as a polish stop for the planarization.

Figure 6:
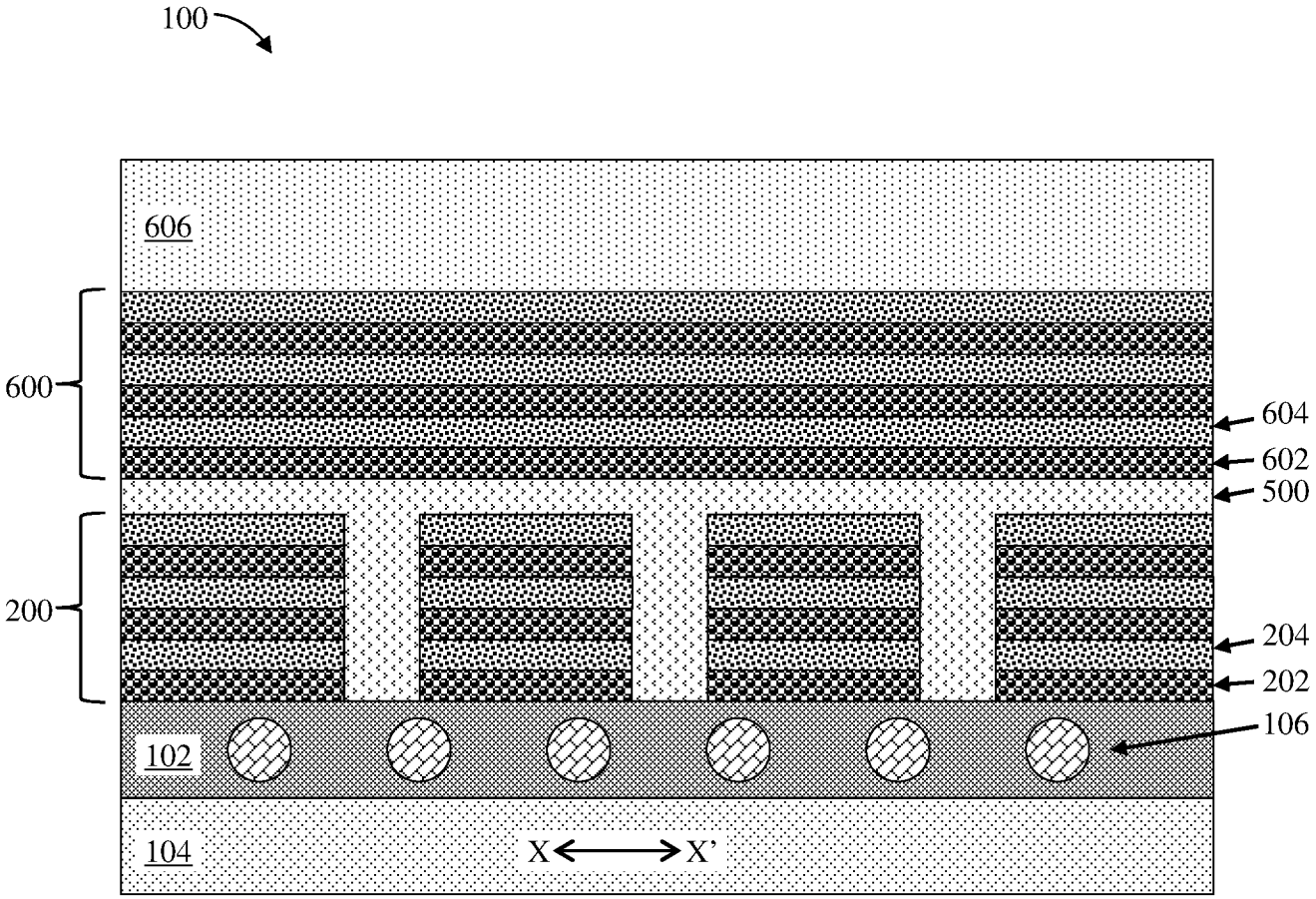
FIG. 6 depicts a laminated magnetic inductor after a fabrication operation according to embodiments of the invention.

FIG. 6 depicts a cross-sectional view of the structure 100 along the direction X-X' after forming an outer layer region 600 opposite a major surface of the dielectric layer 500 during an intermediate operation of a method of fabricating a semiconductor device according to embodiments of the invention. The outer layer region 600 includes one or more outer magnetic layers (e.g., outer magnetic layer 602) alternating with one or more insulating layers (e.g., insulating layer 604). The outer layer region 600 is formed in a similar manner as the first inner layer region 200—by depositing alternating magnetic and insulating layers. For ease of discussion the outer layer region 600 is depicted as having three outer magnetic layers alternating with three insulating layers. It is understood, however, that the outer layer region 600 can include any number of outer magnetic layers alternating with a corresponding number of insulating layers. For example, the outer layer region 600 can include a single outer magnetic layer, two outer magnetic layers, five outer magnetic layers, eight outer magnetic layers, or any number of outer magnetic layers, along with a corresponding number of insulating layers (i.e., as appropriate to form an outer layer region having a topmost insulating layer on a topmost outer magnetic layer and an insulating layer between each pair of adjacent outer magnetic layers). It is further understood that the outer layer region 600 can include a different number of magnetic layers than the first inner layer region 200.

The outer magnetic layer 602 can be made of any suitable magnetic material and can be formed using any suitable process in a similar manner as the inner magnetic layer 202. In some embodiments, the outer magnetic layer 602 is conformally formed to a thickness of about 5 nm to about 100 nm, although other thicknesses are within the contemplated scope of embodiments of the invention. The outer magnetic layer 602 can have a same thickness, a larger thickness, or a smaller thickness as the inner magnetic layer 202 in the first inner layer region 200.

The insulating layer 604 can be made of any suitable non-magnetic insulating material and can be formed using any suitable process in a similar manner as the insulating layer 204. In some embodiments, the insulating layer 604 is conformally formed to a thickness of about 5 nm to about 10 nm, although other thicknesses are within the contemplated scope of embodiments of the invention. The insulating layer 604 can have a same thickness, a larger thickness, or a smaller thickness as the insulating layer 204 in the first inner layer region 200.

As discussed previously herein, the outer layer region 600 is less critical to the overall quality factor of the inductor. Consequently, in some embodiments, the magnetic layers in the outer layer region 600 are not patterned. In this manner the permeability of the outer layer region 600 can be relatively larger than the permeability of first inner layer region 200. Moreover, throughput of the structure 100 can be improved due to the similar processing scheme.

Figure 7:
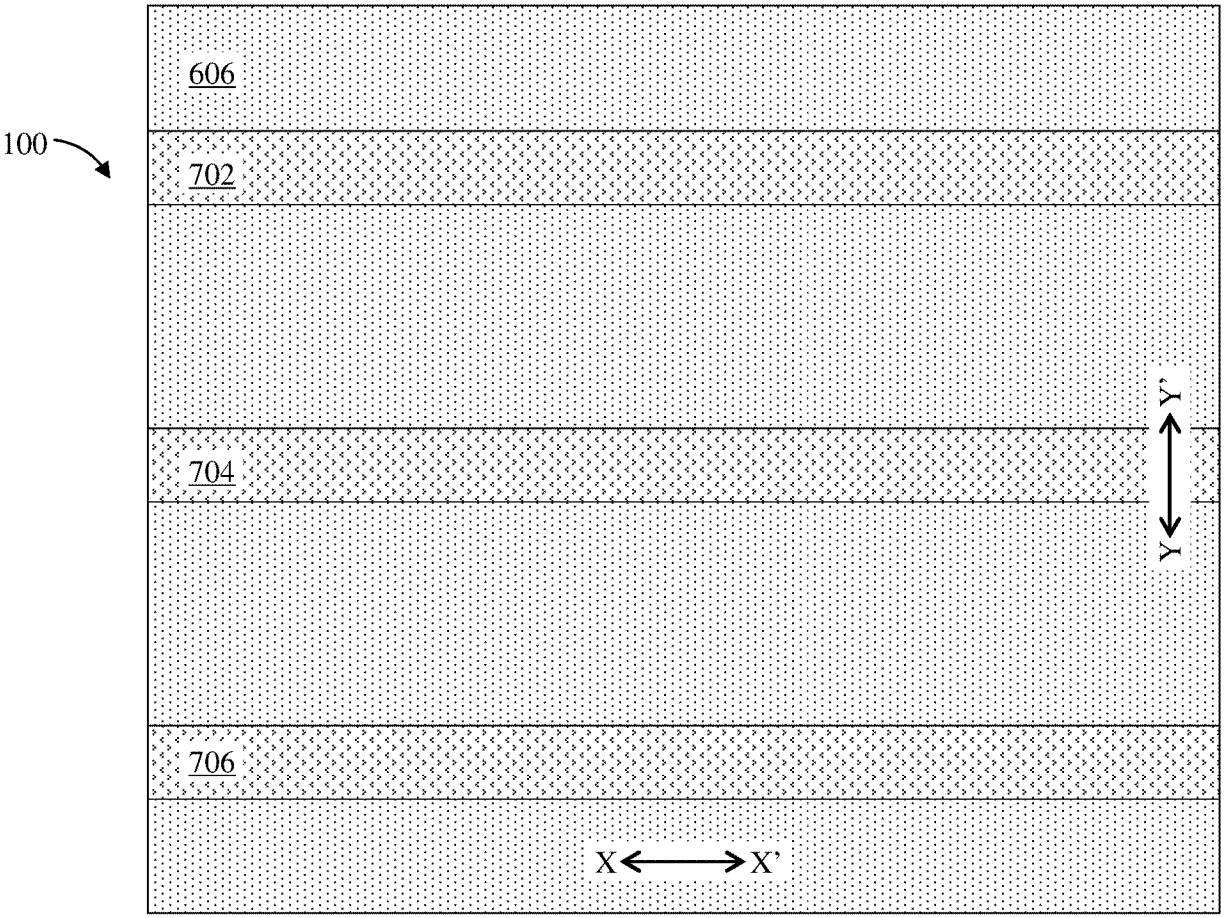
FIG. 7 depicts a laminated magnetic inductor after a fabrication operation according to embodiments of the invention.

In other embodiments, the magnetic layers in the outer layer region 600 (e.g., the outer magnetic layer 602) are patterned by removing portions of the outer layer region 600 to form trenches (e.g., trenches 702, 704, and 706 as depicted in FIG. 7) exposing portions of the dielectric layer 500 in the direction X-X' (i.e., parallel to the hard axis). The outer layer region 600 can be patterned in a similar manner as the first inner layer region 200, using, for example, a wet etch, a dry etch, or a combination of sequential wet and/or dry etches. In some embodiments, the outer layer region 600 is patterned selective to the dielectric layer 500. In some embodiments, the outer layer region 600 is patterned by forming a patterned hard mask 606 (e.g., a photoresist) over the outer layer region 600 and selectively removing exposed portions of the outer layer region 600 using RIE.

Patterning the outer layer region 600 in this manner (i.e., patterning the outer layer region 600 into sections parallel to, rather than perpendicular to, the hard axis) effectively increases the permeability of the outer layer region 600. As discussed previously herein, increasing the effective permeability of the outer layers increases Q while only moderately increasing losses. In some embodiments, the permeability of the outer layer region 600 is further adjusted to modify the frequency of peak Q, in a similar manner as the first inner layer region 200. In some embodiments, the effective permeability of the outer layer region 600 is further increased to decrease the frequency of peak Q. In some embodiments, the effective permeability of the outer layer region 600 is decreased to increase the frequency of peak Q.

FIG. 7 depicts a top-down view of the structure 100 after patterning the outer layer region 600 during an intermediate operation of a method of fabricating a semiconductor device according to embodiments of the invention. From this view it is clear that the exposed portions of the dielectric layer 500 run parallel to the direction X-X'. For ease of discussion reference is made to operations performed on and to a structure 100 having three parallel trenches (e.g., the trenches 702, 704, and 706). It is understood, however, that the structure 100 can be patterned to include any number of trenches.

Figure 8:
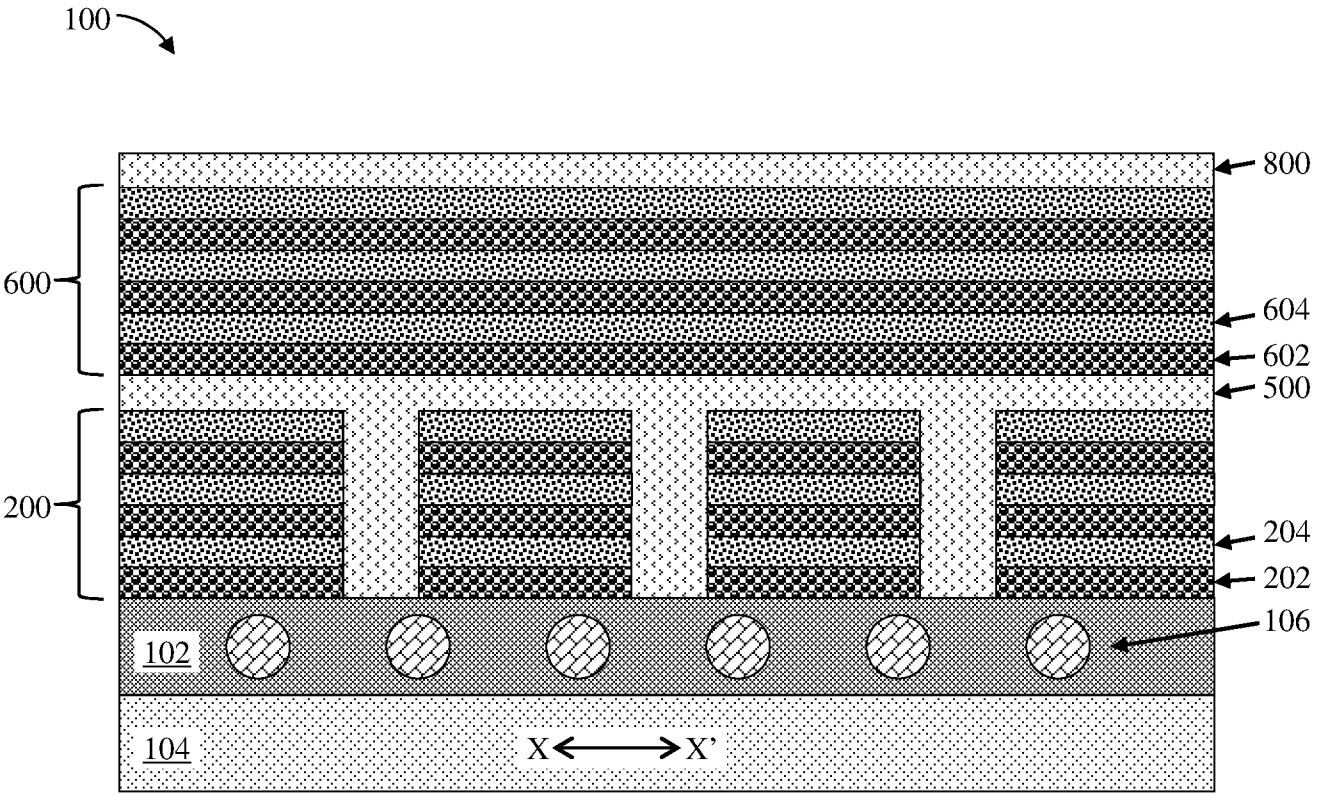
FIG. 8 depicts a laminated magnetic inductor after a fabrication operation according to embodiments of the invention.

FIG. 8 depicts a cross-sectional view of the structure 100 along the direction X-X' after filling the trenches 702, 704, and 706 with a dielectric layer 800 during an intermediate operation of a method of fabricating a semiconductor device according to embodiments of the invention. The dielectric layer 800 can be made of any suitable dielectric material known in the art, such as, for example, aluminum oxides (e.g., alumina), silicon oxides (e.g., $SiO_2$), silicon nitrides, silicon oxynitrides ($SiO_xN_y$), polymers, magnesium oxide (MgO), or any suitable combination of these materials. Any known manner of forming the dielectric layer 800 can be utilized. In some embodiments, the dielectric layer 800 is conformally formed using a conformal deposition process such as PVD, CVD, PECVD, or a combination thereof. The dielectric layer 800 can be overfilled above a major surface of the outer layer region 600. In some embodiments, the dielectric layer 800 is conformally formed to a thickness of about 5 nm to about 10 nm above a major surface of the outer layer region 600, although other thicknesses are within the contemplated scope of embodiments of the invention. In some embodiments, the dielectric layer 800 is planarized using, for example, a CMP selective to the major surface of the outer layer region 600. In some embodiments, a hard mask (not depicted) can be used as a polish stop for the planarization. In some embodiments, the dielectric layer 800 is made of the same material as the dielectric layer 500. In some embodiments, the dielectric layer 800 is made of a different dielectric material than the dielectric layer 500.

Figure 9:
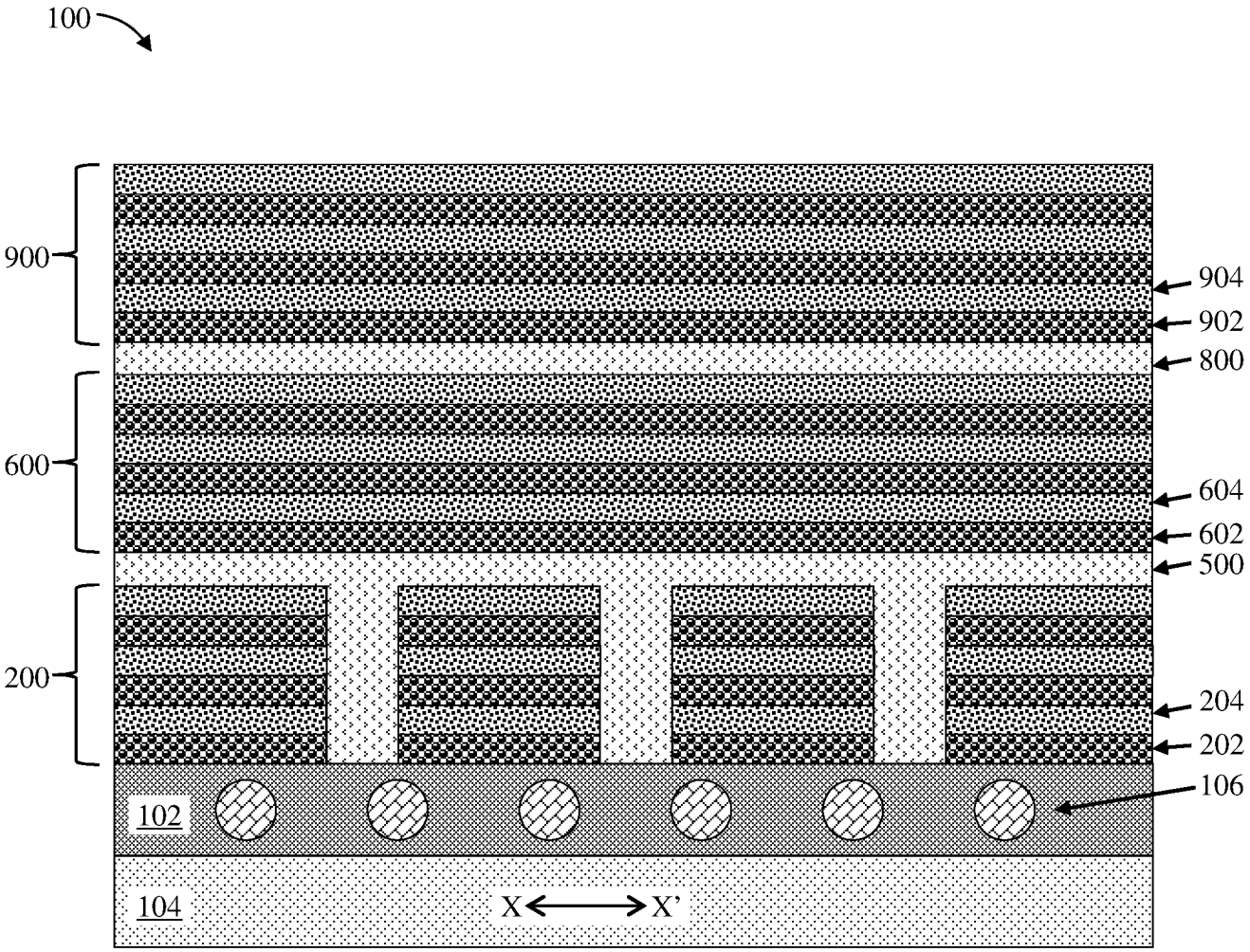
FIG. 9 depicts a laminated magnetic inductor after a fabrication operation according to embodiments of the invention.

FIG. 9 depicts a cross-sectional view of the structure 100 along the direction X-X' after forming a second inner layer region 900 opposite a major surface of the dielectric layer 800 during an intermediate operation of a method of fabricating a semiconductor device according to embodiments of the invention. The second inner layer region 900 includes one or more outer magnetic layers (e.g., second inner magnetic layer 902) alternating with one or more insulating layers (e.g., insulating layer 904). The second inner layer region 900 is formed in a similar manner as the first inner layer region 200—by depositing alternating magnetic and insulating layers. For ease of discussion the second inner layer region 900 is depicted as having three outer magnetic layers alternating with three insulating layers. It is understood, however, that the second inner layer region 900 can include any number of outer magnetic layers alternating with a corresponding number of insulating layers. For example, the second inner layer region 900 can include a single outer magnetic layer, two outer magnetic layers, five outer magnetic layers, eight outer magnetic layers, or any number of outer magnetic layers, along with a corresponding number of insulating layers (i.e., as appropriate to form an inner layer region having a topmost insulating layer on a topmost outer magnetic layer and an insulating layer between each pair of adjacent outer magnetic layers). It is further understood that the second inner layer region 900 can include a different number of magnetic layers than the first inner layer region 200.

The second inner magnetic layer 902 can be made of any suitable magnetic material and can be formed using any suitable process in a similar manner as the inner magnetic layer 202. In some embodiments, the second inner magnetic layer 902 is conformally formed to a thickness of about 5 nm to about 100 nm, although other thicknesses are within the contemplated scope of embodiments of the invention. The second inner magnetic layer 902 can have a same thickness, a larger thickness, or a smaller thickness as the inner magnetic layer 202 in the first inner layer region 200.

The insulating layer 904 can be made of any suitable non-magnetic insulating material and can be formed using any suitable process in a similar manner as the insulating layer 204. In some embodiments, the insulating layer 904 is conformally formed to a thickness of about 5 nm to about 10 nm, although other thicknesses are within the contemplated scope of embodiments of the invention. The insulating layer 904 can have a same thickness, a larger thickness, or a smaller thickness as the insulating layer 204 in the first inner layer region 200.

Figure 10:
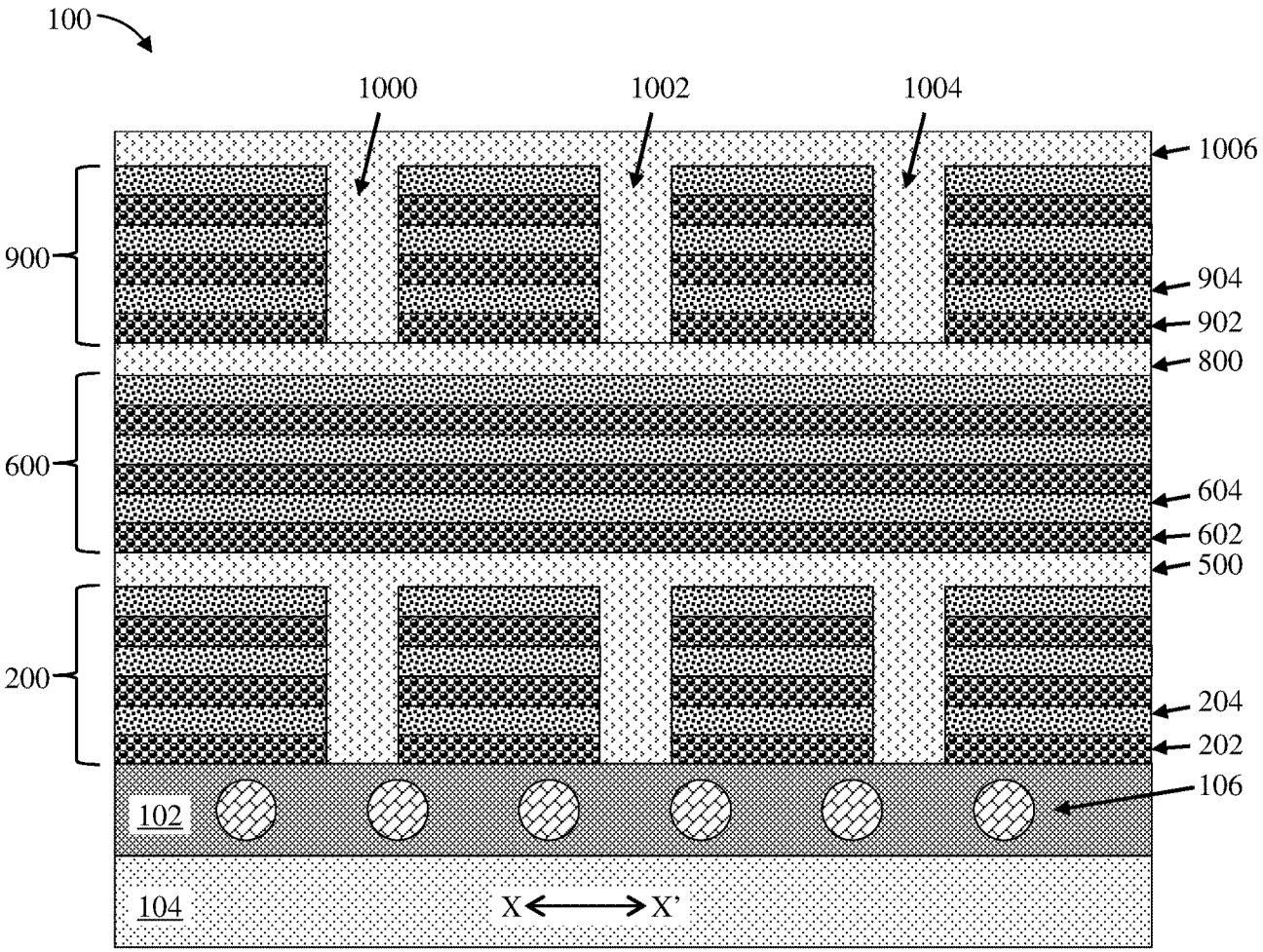
FIG. 10 depicts a laminated magnetic inductor after a fabrication operation according to embodiments of the invention.

FIG. 10 depicts a cross-sectional view of the structure 100 along the direction X-X' after patterning the second inner layer region 900 during an intermediate operation of a method of fabricating a semiconductor device according to embodiments of the invention. The second inner layer region 900 is patterned with trenches 1000, 1002, and 1004 in a similar manner as the first inner layer region 200 (i.e., the second inner layer region 900 is patterned into sections perpendicular to the hard axis). In some embodiments, the second inner layer region 900 is patterned selective to the dielectric layer 800. In some embodiments, the second inner layer region 900 is patterned by forming a patterned hard mask or photoresist (not depicted) over the second inner layer region 900 and selectively removing exposed portions of the second inner layer region 900 using RIE.

Removing portions of the second inner layer region 900 in this manner (i.e., patterning the second inner layer region 900 into sections perpendicular to the hard axis) effectively decreases the permeability of the second inner layer region 900. As discussed previously herein, decreasing the effective permeability of the inner layers reduces the eddy current losses in these critical regions. In some embodiments, the permeability of the second inner layer region 900 is further adjusted to modify the frequency of peak Q, in a similar manner as the first inner layer region 200. In some embodiments, the effective permeability of the second inner layer region 900 is increased to decrease the frequency of peak Q. In some embodiments, the effective permeability of the outer layer region 600 is further decreased to increase the frequency of peak Q.

After patterning the second inner layer region 900 the trenches 1000, 1002, and 1004 are filled with a dielectric layer 1006. The dielectric layer 1006 can be made of any suitable dielectric material known in the art, such as, for example, aluminum oxides (e.g., alumina), silicon oxides (e.g., $SiO_2$), silicon nitrides, silicon oxynitrides ($SiO_xN_y$), polymers, magnesium oxide (MgO), or any suitable combination of these materials. Any known manner of forming the dielectric layer 1006 can be utilized. In some embodiments, the dielectric layer 1006 is conformally formed using a conformal deposition process such as PVD, CVD, PECVD, or a combination thereof. The dielectric layer 1006 can be overfilled above a major surface of the second inner layer region 900. In some embodiments, the dielectric layer 1006 is conformally formed to a thickness of about 5 nm to about 10 nm above a major surface of the second inner layer region 900, although other thicknesses are within the contemplated scope of embodiments of the invention. In some embodiments, the dielectric layer 1006 is planarized using, for example, a CMP selective to the major surface of the second inner layer region 900. In some embodiments, a hard mask (not depicted) can be used as a polish stop for the planarization.

Figure 11:
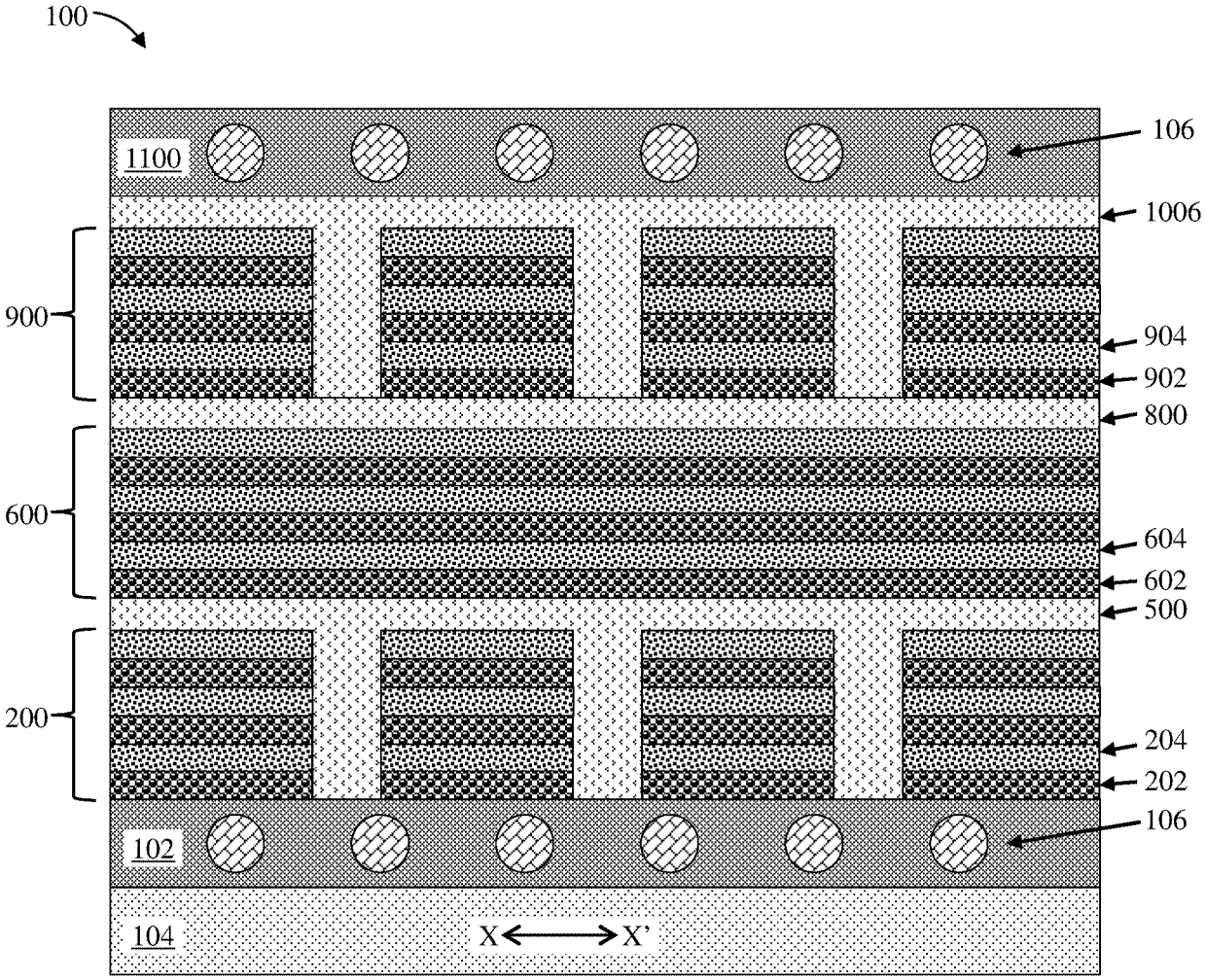
FIG. 11 depicts a laminated magnetic inductor after a fabrication operation according to embodiments of the invention.

FIG. 11 depicts a cross-sectional view of the structure 100 along the direction X-X' after forming a dielectric layer 1100 (also referred to as a top dielectric layer) opposite a major surface of the dielectric layer 1006 during an intermediate operation of a method of fabricating a semiconductor device according to embodiments of the invention. The dielectric layer 1100 can be any suitable material, such as, for example, a low-k dielectric, SIN, $SiO_2$, SiON, and SiOCN. Any known manner of forming the dielectric layer 1100 can be utilized. In some embodiments, the dielectric layer 1100 is $SiO_2$ conformally formed on exposed surfaces of the dielectric layer 1006 using a conformal deposition process such as PVD, CVD, PECVD, or a combination thereof. In some embodiments, the dielectric layer 1100 is conformally formed to a thickness of about 50 nm to about 400 nm, although other thicknesses are within the contemplated scope of embodiments of the invention.

As discussed previously herein, the conductive coil 106 is helically wound through the dielectric layer 1100 and around portions of the structure 100. For ease of discussion reference is made to operations performed on and to a conductive coil 106 having six turns or windings formed in the dielectric layer 1100. It is understood, however, that the dielectric layer 1100 can include any number of windings. For example, the dielectric layer 1100 can include a single winding, 2 windings, 5 windings, 10 windings, or 20 windings, although other winding counts are within the contemplated scope of embodiments of the invention.

In some embodiments, the structure 100 is patterned into two or more laminated stacks (not depicted) and the windings of the conductive coil 106 are split among the laminated stacks. For example, the structure 100 can be patterned into three laminated stacks each having two windings of the conductive coil 106. Any known method for patterning laminated stacks can be used, such as, for example, a wet etch, a dry etch, or a combination of sequential wet and/or dry etches followed by a dielectric fill or deposition. In some embodiments, edge portions of the first inner layer region 200, the outer layer region 600, and the second inner layer region 900 are removed using, for example, RIE, to form cavities (not depicted) that are then filled with dielectric material. The cavities can be patterned such that a first end of the dielectric material is in contact with the dielectric layer 102 and a second end of the dielectric material is in contact with the dielectric layer 1100.

Figure 12:
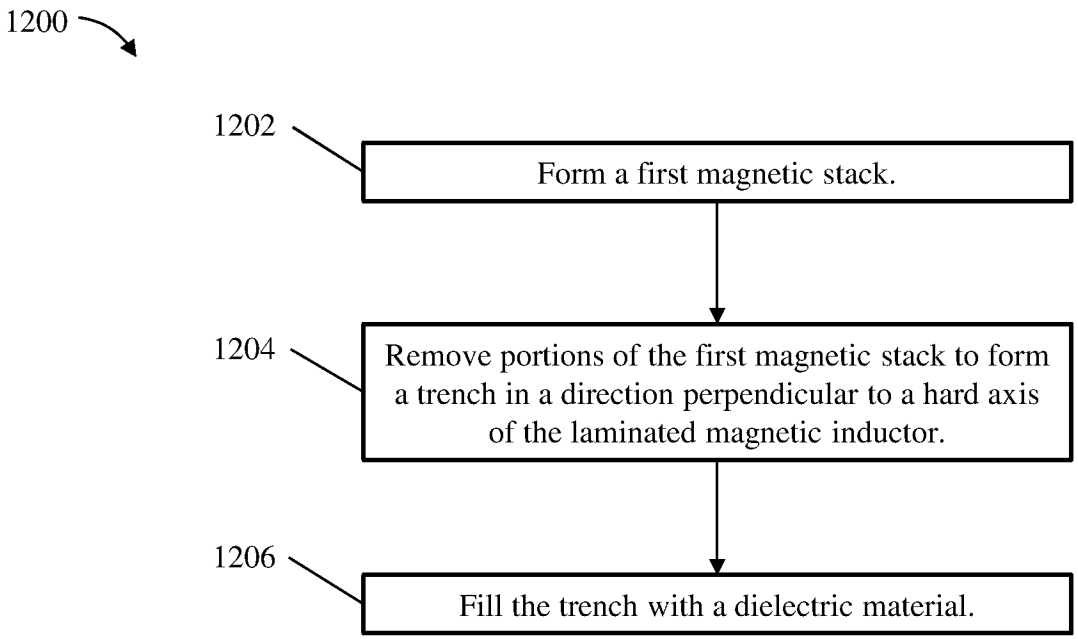
FIG. 12 depicts a flow diagram illustrating a method according to one or more embodiments of the invention.

FIG. 12 depicts a flow diagram illustrating a method for forming a laminated magnetic inductor according to one or more embodiments of the invention. As shown at block 1202, a first magnetic stack is formed having one or more magnetic layers alternating with one or more insulating layers. The magnetic layers of the first magnetic stack can be formed in a similar manner as the inner magnetic layer 202 (as depicted in FIG. 2) according to one or more embodiments. The insulating layers of the first magnetic stack can be formed in a similar manner as the insulating layer 204 (as depicted in FIG. 2) according to one or more embodiments.

As shown at block 1204, portions of the first magnetic stack are removed to form a trench in a direction perpendicular to a hard axis of the laminated magnetic inductor according to one or more embodiments. In some embodiments, the first magnetic stack is patterned by forming a patterned hard mask and/or photoresist over the first magnetic stack and selectively removing exposed portions of the first magnetic stack using RIE.

As shown at block 1206, the trench is filled with a dielectric material according to one or more embodiments. The dielectric material can be made of any suitable dielectric material known in the art, such as, for example, aluminum oxides (e.g., alumina), silicon oxides (e.g., $SiO_2$), silicon nitrides, $SiO_xN_y$, polymers, MgO, or any suitable combination of these materials. In some embodiments, the dielectric material is conformally formed using PVD, CVD, PECVD, or a combination thereof.

As discussed previously herein, the laminated stack can be structured such that a thickness of the first and third magnetic layers is less than a thickness of the second magnetic layer. In this manner, eddy current losses can be controlled in critical regions (i.e., the first and second inner regions) while providing improved throughput in noncritical regions (i.e., the outer region).

Various embodiments of the present invention are described herein with reference to the related drawings. Alternative embodiments can be devised without departing from the scope of this invention. Although various connections and positional relationships (e.g., over, below, adjacent, etc.) are set forth between elements in the following description and in the drawings, persons skilled in the art will recognize that many of the positional relationships described herein are orientation-independent when the described functionality is maintained even though the orientation is changed. These connections and/or positional relationships, unless specified otherwise, can be direct or indirect, and the present invention is not intended to be limiting in this respect. Similarly, the term "coupled" and variations thereof describes having a communications path between two elements and does not imply a direct connection between the elements with no intervening elements/connections between them. All of these variations are considered a part of the specification. Accordingly, a coupling of entities can refer to either a direct or an indirect coupling, and a positional relationship between entities can be a direct or indirect positional relationship. As an example of an indirect positional relationship, references in the present description to forming layer "A" over layer "B" include situations in which one or more intermediate layers (e.g., layer "C") is between layer "A" and layer "B" as long as the relevant characteristics and functionalities of layer "A" and layer "B" are not substantially changed by the intermediate layer(s).

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection."

References in the specification to "one embodiment," "an embodiment," "an example embodiment," etc., indicate that the embodiment described can include a particular feature, structure, or characteristic, but every embodiment may or may not include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of the description hereinafter, the terms "upper," "lower," "right," "left," "vertical," "horizontal," "top," "bottom," and derivatives thereof shall relate to the described structures and methods, as oriented in the drawing figures. The terms "overlying," "atop," "on top," "positioned on" or "positioned atop" mean that a first element, such as a first structure, is present on a second element, such as a second structure, wherein intervening elements such as an interface structure can be present between the first element and the second element. The term "direct contact" means that a first element, such as a first structure, and a second element, such as a second structure, are connected without any intermediary conducting, insulating or semiconductor layers at the interface of the two elements.

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

The phrase "selective to," such as, for example, "a first element selective to a second element," means that the first element can be etched and the second element can act as an etch stop.

The term "conformal" (e.g., a conformal layer) means that the thickness of the layer is substantially the same on all surfaces, or that the thickness variation is less than 15% of the nominal thickness of the layer.

As previously noted herein, for the sake of brevity, conventional techniques related to semiconductor device and integrated circuit (IC) fabrication may or may not be described in detail herein. By way of background, however, a more general description of the semiconductor device fabrication processes that can be utilized in implementing one or more embodiments of the present invention will now be provided. Although specific fabrication operations used in implementing one or more embodiments of the present invention can be individually known, the described combination of operations and/or resulting structures of the present invention are unique. Thus, the unique combination of the operations described in connection with the fabrication of a semiconductor device according to the present invention utilize a variety of individually known physical and chemical processes performed on a semiconductor (e.g., silicon) substrate, some of which are described in the immediately following paragraphs.

In general, the various processes used to form a microchip that will be packaged into an IC fall into four general categories, namely, film deposition, removal/etching, semiconductor doping and patterning/lithography. Deposition is any process that grows, coats, or otherwise transfers a material onto the wafer. Available technologies include physical vapor deposition (PVD), chemical vapor deposition (CVD), electrochemical deposition (ECD), molecular beam epitaxy (MBE) and more recently, atomic layer deposition (ALD) among others. Removal/etching is any process that removes material from the wafer. Examples include etch processes (either wet or dry), chemical-mechanical planarization (CMP), and the like. Reactive ion etching (RIE), for example, is a type of dry etching that uses chemically reactive plasma to remove a material, such as a masked pattern of semiconductor material, by exposing the material to a bombardment of ions that dislodge portions of the material from the exposed surface. The plasma is typically generated under low pressure (vacuum) by an electromagnetic field. Semiconductor doping is the modification of electrical properties by doping, for example, transistor sources and drains, generally by diffusion and/or by ion implantation. These doping processes are followed by furnace annealing or by rapid thermal annealing (RTA). Annealing serves to activate the implanted dopants. Films of both conductors (e.g., poly-silicon, aluminum, copper, etc.) and insulators (e.g., various forms of silicon dioxide, silicon nitride, etc.) are used to connect and isolate transistors and their components. Selective doping of various regions of the semiconductor substrate allows the conductivity of the substrate to be changed with the application of voltage. By creating structures of these various components, millions of transistors can be built and wired together to form the complex circuitry of a modern microelectronic device. Semiconductor lithography is the formation of three-dimensional relief images or patterns on the semiconductor substrate for subsequent transfer of the pattern to the substrate. In semiconductor lithography, the patterns are formed by a light sensitive polymer called a photo-resist. To build the complex structures that make up a transistor and the many wires that connect the millions of transistors of a circuit, lithography and etch pattern transfer steps are repeated multiple times. Each pattern being printed on the wafer is aligned to the previously formed patterns and slowly the conductors, insulators and selectively doped regions are built up to form the final device.

The flowchart and block diagrams in the Figures illustrate possible implementations of fabrication and/or operation methods according to various embodiments of the present invention. Various functions/operations of the method are represented in the flow diagram by blocks. In some alternative implementations, the functions noted in the blocks can occur out of the order noted in the Figures. For example, two blocks shown in succession can, in fact, be executed substantially concurrently, or the blocks can sometimes be executed in the reverse order, depending upon the functionality involved.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A method of fabricating a laminated stack of a magnetic inductor, the method comprising:

forming a first magnetic stack comprising a plurality of magnetic layers alternating with a plurality of insulating layers;

forming a trench in the first magnetic stack, wherein an axis of the trench is perpendicular to a hard axis of the magnetic inductor;

filling the trench with a dielectric material; and then forming a second magnetic stack comprising a plurality of magentic layers alternating with a plurality of insulating layers on a top surface of the first magnetic stack.

2. The method of claim 1 further comprising:

forming a trench in the second magnetic stack, wherein an axis of the trench is parallel to the hard axis of the magnetic inductor; and filling the trench with a dielectric material.

3. The method of claim 1 further comprising forming a third magnetic stack comprising a plurality of magnetic layers alternating with a plurality of insulating layers opposite a major surface of the second magnetic stack.

4. The method of claim 3 further comprising:

forming a trench in the third magnetic stack, wherein an axis of the trench is perpendicular to the hard axis of the magnetic inductor; and filling the trench with a dielectric material.

5. The method of claim 4, wherein the first and third magnetic stacks are positioned proximate to a conductive coil of the magnetic inductor.

6. The method of claim 5, wherein the second magnetic stack is positioned between the first and third magnetic stacks such that the second magnetic stack is further from the conductive coil than either the first magnetic stack or the second magnetic stack.

7. The method of claim 1, wherein the one or more magnetic layers in the first magnetic stack comprise cobalt (Co), FeTaN, FeNi, FeAlO, or a combination thereof.

8. The method of claim 1, wherein each magnetic layer of the first magnetic stack comprises a thickness of about 10 nm to about 800 nm.

9. The method of claim 8, wherein each magnetic layer of the first magnetic stack comprises a thickness of about 50 nm to about 200 nm.

10. The method of claim 1, wherein the one or more insulating layers in the first magnetic stack comprise alumina ($Al_2O_3$), silicon dioxide ($SiO_2$), a silicon nitride, a silicon oxynitride ($SiO_xN_y$), magnesium oxide (MgO), or a combination thereof.

11. The method of claim 10, wherein each insulating layer of the first magnetic stack comprises a thickness of about 5 nm to about 500 nm.

12. The method of claim 11, wherein each insulating layer of the first magnetic stack comprises a thickness of about 5 nm to about 10 nm.

* * * * *